US006505591B1

(12) United States Patent
Hayman et al.

(10) Patent No.: US 6,505,591 B1
(45) Date of Patent: Jan. 14, 2003

(54) VALVE TRAIN WITH ASSEMBLY GUIDES

(75) Inventors: Alan William Hayman, Romeo, MI (US); Terry Wayne Black, Clarkston, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/916,127

(22) Filed: Jul. 27, 2001

(51) Int. Cl.[7] ..... F01L 1/18

(52) U.S. Cl. ..... 123/90.39; 123/90.61; 123/90.47

(58) Field of Search ..... 123/90.39, 90.61, 123/90.47

(56) References Cited

U.S. PATENT DOCUMENTS 4,453,505 A * 6/1984 Holtzberg et al. ..... 123/90.61
4,829,949 A * 5/1989 Holmer ..... 123/90.16
6,148,780 A * 11/2000 O'Neill et al. ..... 123/90.46

* cited by examiner

*Primary Examiner*—Thomas Denion
*Assistant Examiner*—Jaime Corrigan
(74) *Attorney, Agent, or Firm*—Leslie C. Hodges

(57) ABSTRACT

A valve train with components connected by ball and socket joints is provided with projecting assembly guides adjacent the sockets of selected joints. The assembly guides include guide surfaces angling toward the sockets to guide the ball end of a push rod or other actuator into the socket of an associated rocker arm or other component. The guide surfaces may be generally conical or comprised of multiple spaced surfaces. The assembly guides facilitate assembly of valve trains, especially where components with multiple ball and socket joints are involved.

9 Claims, 2 Drawing Sheets

VALVE TRAIN WITH ASSEMBLY GUIDES

TECHNICAL FIELD

This invention relates to engine valve trains and, more particularly, to valve trains with ball and socket-type joints.

BACKGROUND OF THE INVENTION

It is known in the art relating to engine valve trains to provide actuating members, such as rocker arms and push rods or other components, having ball and socket-type joint connections. In some embodiments, more than one rocker arm and/or push rod or other actuator may be utilized in a train to actuate a single valve or multiple valves. Assembly of such valve trains can require excessive time in alignment of the components. For example, connecting a push rod between a pair of rocker arms at ball and socket joints in order to insert the ball ends into the sockets may require simultaneously depressing the valve actuating rocker against the valve spring. Also, insertion of a single push rod into a rocker arm socket may prove difficult in alignment of the components.

SUMMARY OF THE INVENTION

The present invention facilitates the assembly of valve trains with ball and socket-type joints by providing, where appropriate, assembly guides to aid in inserting and aligning an actuating member, such as a push rod, with one or more sockets on a mating actuating member or members. In an exemplary embodiment, a primary push rod engages and actuates a primary rocker arm which is connected with a secondary push rod engaging and actuating a second rocker arm that directly actuates a valve. The primary push rod has a spherical or ball end which is received in a socket of the primary rocker arm to aid alignment and insertion of the push rod with the rocker arm socket. The invention provides a conical guide surrounding the socket which slopes inwardly toward the socket and, upon assembly, guides the end of the push rod into position in the socket with a minimum of manual guidance.

The secondary push rod must be aligned with and inserted into sockets on both the primary and the secondary rocker arms. To assist this process, the invention provides guides, each having at least one guide surface which, in a preferred embodiment, comprises a partial cone surface extending out from the lower side of each of the rocker arm sockets. In assembly, the valve actuating rocker arm is rotated in a valve opening direction and the push rod is laid upon the part-conical guide surfaces. The valve actuating rocker arm is then released and returned by the valve spring to the actuating position, causing the ends of the push rod to ride up the assembly guides and slide into the sockets on the rocker arms in its operating position.

These and other features and advantages of the invention will be more fully understood from the following description of certain specific embodiments of the invention taken together with the accompanying drawings.

DESCRIPTION OF THE PREFERRED EMBODIMENT

Figure 1:
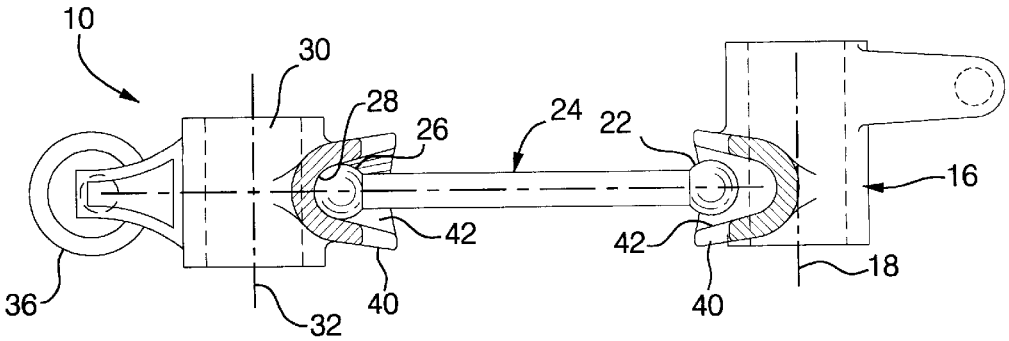
FIG. 1 is a plan view in fragmentary cross section of a nearly assembled exemplary valve train arrangement including assembly guides in accordance with the invention.
Figure 2:
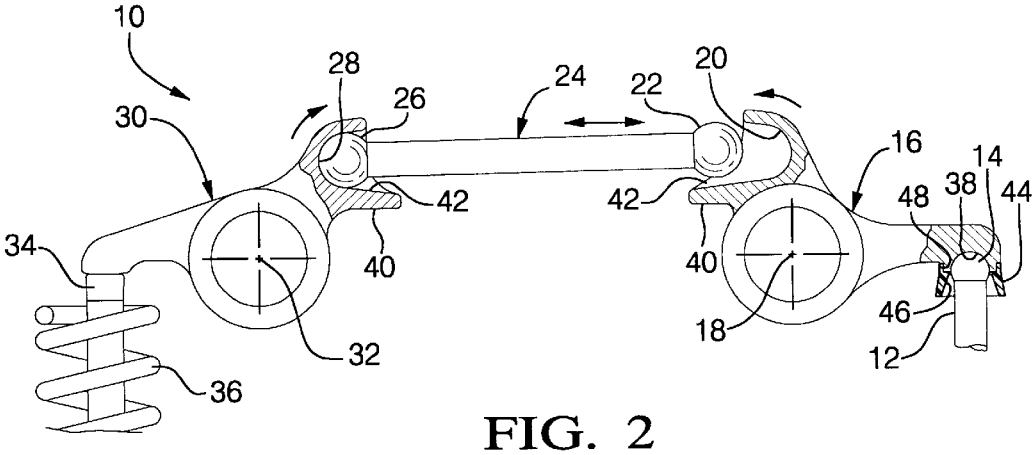
FIG. 2 is a side view in fragmentary cross section of the valve train arrangement of FIG. 1.
Figure 3:
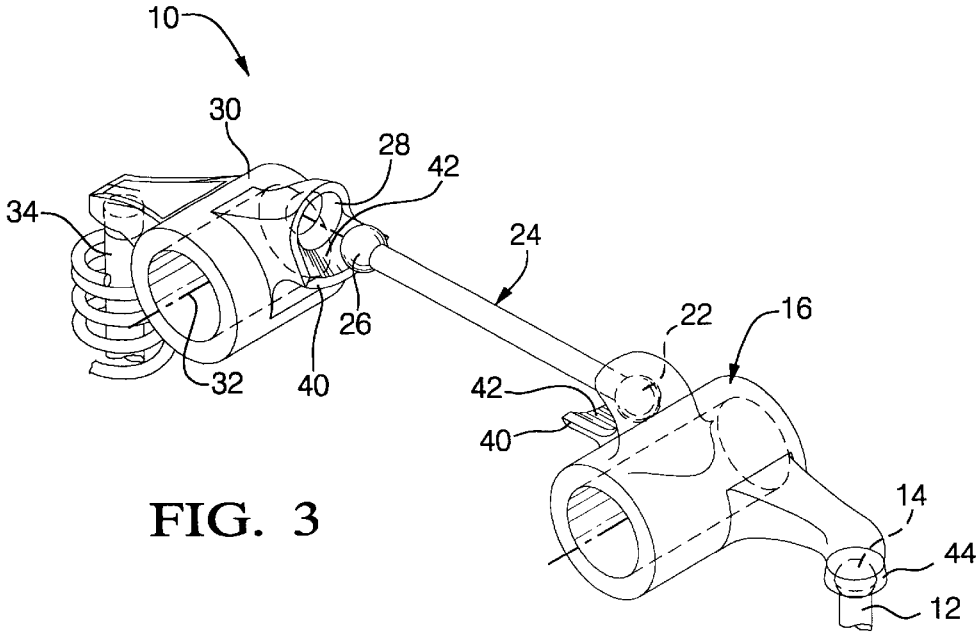
FIG. 3 is a pictorial view of the arrangement of FIGS. 1 and 2 showing a push rod in a nearly installed position.

Referring now to the drawings in detail, numeral 10 generally indicates an exemplary valve train arrangement including ball and socket-type joints provided with assembly guides in accordance with the invention.

Valve train 10 includes a primary push rod 12 connected at a ball and socket joint 14 with a primary rocker arm 16. Rocker arm 16 pivots on an axis 18 and includes a second socket 20 in which a ball end 22 of a secondary push rod 24 is received. A second ball end 26 of push rod 24 is received in a socket 28 of a secondary rocker arm 30 which is pivotable about a secondary axis 32. The secondary rocker arm 30 further engages a valve stem 34 for actuating a valve which is closed by a valve spring 36.

Assembly of the valve train as described, without assembly guides according to the invention, may be accomplished in any desired manner. However one possible assembly process could involve:

- Installation of the primary push rod 12 into a cam follower, not shown;
- Alignment of the primary push rod 12 with a socket 38 of the joint 14 and rotation of the rocker arm 16 to engage push rod 12;
- Rotation of the secondary rocker arm 30 against the valve stem 34 and spring 36 to provide clearance for insertion of the secondary push rod 24;
- Alignment of the secondary push rod ball ends 22, 26 with sockets 20, 28 of the primary and secondary rocker arms; and
- Rotation of the secondary rocker arm 30 by the spring 36 back to the valve closed position to engage the ball ends of push rod 24 with their respective sockets in rocker arms 16, 30.

The process as described requires care in aligning and maintaining alignment of the components while they are being installed in their respective ball and socket joint connections, which may lead to increased assembly time or misalignment leading to repeated attempts to complete the assembly process.

To facilitate assembly, sockets 20, 28 of rocker arms 16, 30 are each provided with an assembly guide 40 in the form of a protruding lip having a part conical guide surface 42 which slopes inward toward its respective socket 20 or 28. If desired, the continuous lip of assembly guide 40 could be replaced by a plurality of rods or other individual projections, each providing a sloping surface angled toward its respective socket 22 or 28. As shown, the assembly guides 40 are preferably cast in place as part of the rocker arms 16, 30. However, they could alternatively be formed as separate components subsequently attached to their respective rocker arms in any suitable fashion. For example, they could be made of plastic and snapped into suitable projection pegs surrounding the rocker arm sockets.

The ball and socket joint 14 between push rod 12 and rocker arm 16 provides an example of the alternative proposal mentioned above. The rocker arm 16 includes an assembly guide 44 made as a separate component of any suitable metal or plastic material. The guide 44 is provided with an internal conical guide surface 46 and is configured with a connecting end 48 which snaps over a machined portion of the rocker arm 16 surrounding socket 38 of the joint 14. The assembly guide 44 may, if desired, be made of lightweight plastic material in order to minimize the inertia of the valve train during actuation of the valve.

Assembly of the valve train described may be accomplished with the same steps previously described. However, the assembly process is made easier by the assembly guides 40, 44 provided. For example, the initial insertion of the push rod 12 into the socket 38 of joint 14 is made easier by the conical assembly guide surface 46 which requires less accurate alignment of the components and guides the end of the push rod 12 into position in the socket 38 as the rocker arm 16 is rotated to connect with the push rod. Likewise, installation of the secondary push rod 24 is made easier. When the rocker arm 30 is rotated against the valve spring 36, the push rod 24 is merely placed in position with its ball ends 22, 26 on the guide surfaces 42 of the assembly guides 40. The rocker arm 30 is then allowed to return to the assembled position, and the push rod ball ends are guided by the conical guide surfaces 42 up into their respective sockets 20, 28 of the associated rocker arms 16, 30.

Thus, it is seen that the provision of assembly guides adjacent to the sockets of the associated ball and socket joints considerably simplifies assembly of the components of a valve train by reducing or avoiding the necessity of aligning the parts carefully and instead providing guidance of the ball components as they are inserted into their respective sockets.

Figure 4:
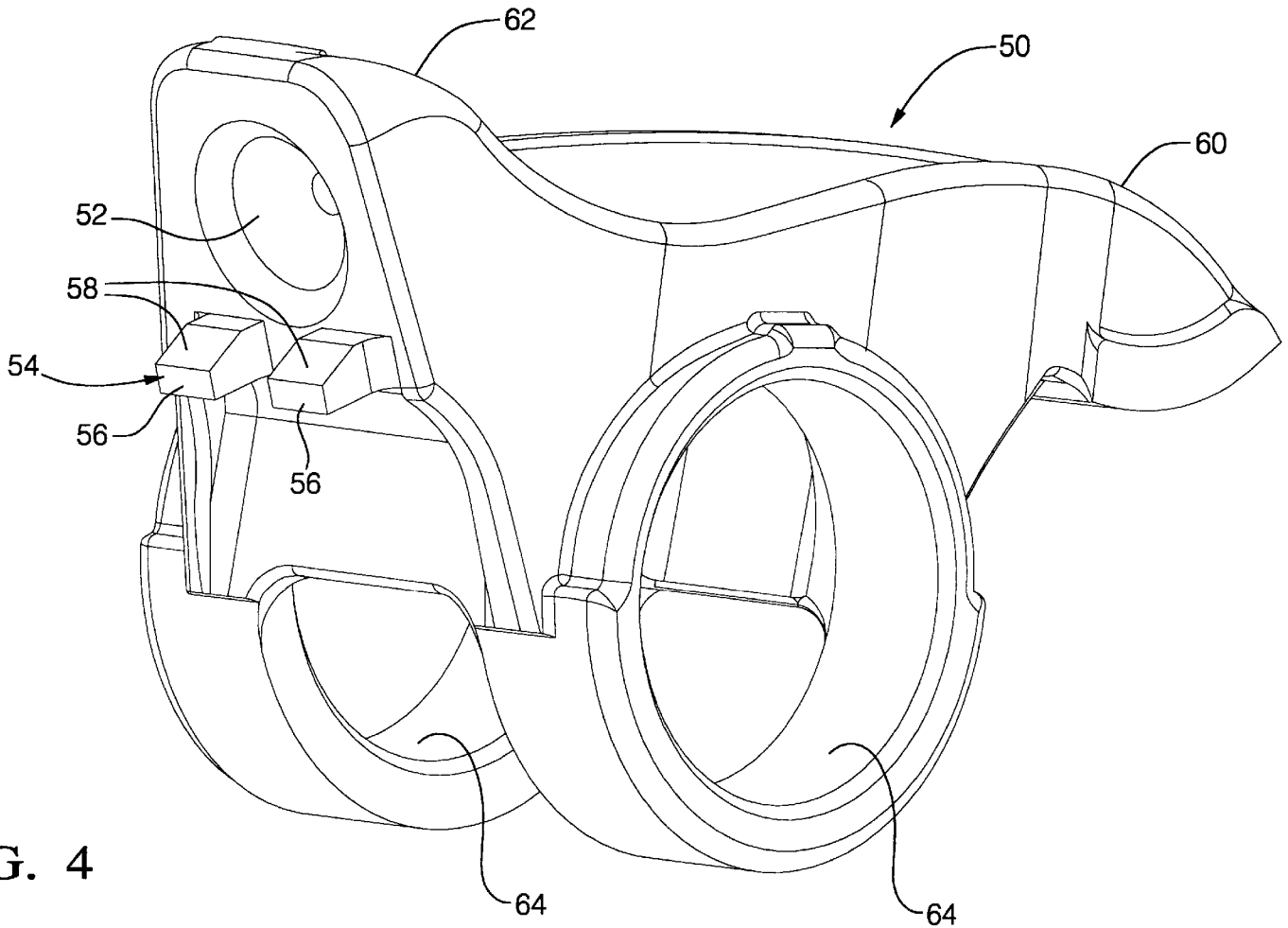
FIG. 4 is a pictorial view of an alternative rocker arm having multiple assembly guide projections adjacent to a ball socket.

FIG. 4 illustrates an alternative valve actuating rocker arm 50 including a ball socket 52 for receiving a ball end push rod (such as rod 24) or another actuating member. An assembly guide 54 is provided below the socket 52 and is formed by a pair of protrusions 56 having guide surfaces 58 angled upwardly toward the socket 52. The assembly guide 54 is used as described earlier to support a ball end of a push rod and guide the ball end up into the socket 52 as the rocker arm 50 is pivoted toward engagement of the socket 52 with the push rod. A rocker arm may have any suitable configuration as called for by the valve train application. In this case, a valve actuating arm 60 and a socket carrying connecting arm 62 are supported by spaced bearing portions 64 for pivotally mounting the rocker arm 50 on a shaft or other supporting pivot.

The terms "ball" and "ball end" are used herein to indicate a socket engaging connecting portion and should be broadly interpreted to include various suitable bearing connections for engaging a socket. Such connections may, without limitation, include ring-shaped or part spherical bearings having continuous or interrupted bearing surfaces as may be appropriate.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. An engine valve train including a pair of components connected at a joint including a socket on a first component and a ball on a second component for engaging the socket on the first component, the valve train comprising:

an assembly guide on the first component and disposed adjacent the socket, said guide defining at least one guide surface against which the ball of the second component may be placed during assembly of the valve train, the guide surface being configured to guide the ball into the socket as the second component is relatively advanced toward engagement with the socket of the first component;

wherein the guide surface angles out from one side of the socket, an adjacent side being open so that the ball may be inserted laterally against the guide surface and then slid generally longitudinally along the guide surface whereby the ball is guided to the socket.

2. An engine valve train as in claim 1 wherein the guide surface approximates a portion of a cone.

3. An engine valve train as in claim 1 wherein the guide surface is interrupted to form a plurality of cooperating surfaces spaced peripherally along an edge of the socket.

4. An engine valve train as in claim 1 wherein the first component is a first rocker arm and the second component is an actuating member.

5. An engine valve train as in claim 4 and including a second rocker arm having a socket and wherein the actuating member is a push rod having a ball at each end, the balls engaging in assembly the sockets of both rocker arms for actuating the second rocker arm upon actuation of the first rocker arm, each of the sockets having a part conical guide surface along one side, an opposite side being open, whereby the rocker arm sockets may be pivoted apart and the push rod may be inserted laterally against the guide surfaces of both sockets and guided by the guide surfaces into both sockets upon return of the rocker arms to operative positions.

6. An engine valve train as in claim 5 wherein the first rocker arm has a primary socket engaged in assembly by a primary push rod, and a generally conical guide surface adjacent to and angled toward the primary socket for guiding the primary push rod into the socket during assembly.

7. An engine valve train as in claim 6 wherein at least one of the guide surfaces is formed on a separate part attached to a component carrying the associated socket.

8. An engine valve train as in claim 7 wherein the separate part is formed from a plastic material.

9. An engine valve train including a pair of components connected at a joint including a socket on a first component and a ball on a second component for engaging the socket on the first component, the valve train comprising:

an assembly guide on the first component and disposed adjacent the socket, said guide defining at least one guide surface against which the ball of the second component may be placed during assembly of the valve train, the guide surface being configured to guide the ball into the socket as the second component is relatively advanced toward engagement with the socket of the first component;

wherein the assembly guide is formed by multiple protrusions adjacent the socket and includes guide surfaces operative to guide a connecting end into the socket during assembly of the valve train.

* * * * *